US011927077B2

(12) United States Patent
Tian et al.

(10) Patent No.: US 11,927,077 B2
(45) Date of Patent: Mar. 12, 2024

(54) HIGH-FREQUENCY COMPOSITE IMPACTOR

(71) Applicants: Southwest Petroleum University, Chengdu (CN); Sichuan Xieming Technology Co., Ltd., Chengdu (CN)

(72) Inventors: Jialin Tian, Chengdu (CN); Lanhui Mao, Chengdu (CN); Yanniu Ren, Chengdu (CN); Lin Yang, Chengdu (CN); Haolin Song, Chengdu (CN); Bo He, Chengdu (CN); Jun Li, Chengdu (CN); Lei Cha, Chengdu (CN); Zhe Zhang, Chengdu (CN); Yu Wei, Chengdu (CN)

(73) Assignees: Southwest Petroleum University, Chendu (CN); Sichuan Xieming Technology Co., Ltd., Chengdu (CN)

( * ) Notice: Subject to any disclaimer, the term of this patent is extended or adjusted under 35 U.S.C. 154(b) by 16 days.

(21) Appl. No.: 17/935,487

(22) Filed: Sep. 26, 2022

(65) Prior Publication Data

US 2024/0052705 A1 Feb. 15, 2024

(30) Foreign Application Priority Data

Aug. 12, 2022 (CN) ..... 202210967533.1

(51) Int. Cl.
*E21B 4/16* (2006.01)
*E21B 4/14* (2006.01)

(52) U.S. Cl.
CPC . *E21B 4/16* (2013.01); *E21B 4/14* (2013.01)

(58) Field of Classification Search
CPC ..... E21B 4/16; E21B 4/14
See application file for complete search history.

(56) References Cited

U.S. PATENT DOCUMENTS

| | | | | |
|---|---|---|---|---|
| 2,911,192 | A * | 11/1959 | Boucher | E21B 7/24 175/57 |
| 5,205,363 | A * | 4/1993 | Pascale | E21B 4/14 173/17 |
| 2003/0062176 | A1* | 4/2003 | Beccu | B25B 21/02 173/93.6 |
| 2018/0171717 | A1* | 6/2018 | Chen | E21B 4/006 |
| 2019/0330931 | A1* | 10/2019 | Zeng | E21B 17/1078 |

* cited by examiner

*Primary Examiner* — Brad Harcourt
(74) *Attorney, Agent, or Firm* — Andrew D. Fortney; Central California IP Group, P.C.

(57) ABSTRACT

A high-frequency composite impactor including a high-frequency axial and a torsional impact assembly is disclosed. The high-frequency axial impact assembly includes an upper self-excited oscillation cavity, a lower self-excited oscillation cavity, an adjustment block and a lock nut. The torsional impact assembly includes an upper end cover, a reversing switch, a pendulum, a lower shell, a lower end cover, a nozzle, a connecting block and a retaining ring. The high-frequency axial impact assembly converts the flowing drilling fluid into a pulsed jet to achieve a high-frequency axial impact. The torsional impact assembly enables a torsional impact through a shunt, and finally enables a high-frequency composite impact, which can effectively reduce the stick-slip of the drill string, jump drilling and other downhole accidents. By reducing the friction between the drill string and the borehole wall, the impactor can reduce WOB loss, increase the ROP, and improve the drilling efficiency.

16 Claims, 6 Drawing Sheets

HIGH-FREQUENCY COMPOSITE IMPACTOR

TECHNICAL FIELD

The invention relates to the technical field of oil drilling, in particular to a high-frequency composite impactor.

BACKGROUND OF THE INVENTION

With the development of oil and gas extraction technology, shallow oil and gas resources can't fully meet the needs of energy extraction, and oil and gas drilling are developing into complex conditions such as ultra-deep and long horizontal distance wells. With the drilling depth continue increasing, the underground formation structures are more uncertain, such as different rock layer properties, high formation pressure, and more difficult rock breaking. The uncertain geological environment between the drilling tool and formation can lead to various frictions effect on drill string systems, which have different degrees of influence on drilling ROP (rate of penetration). Usually, when encountering beyond medium-hard and inhomogeneous rock formations, the rock-breaking efficiency of drill bit is reduced greatly during drilling. Downhole hard rock has the characteristics of high brittleness and high static strength, but its impact resistance is weak. So, if an impact load with a certain frequency, which is generated by one downhole impactor, is applied on the rock, the impact load can expand the cracks and fissures of the rock further, so that the mechanical strength of the cut rock is reduced greatly, which is beneficial for enhancing the drill bit's rock breaking efficiency.

Due to the requirements of ultra-deep wells, the length of drill strings increase greatly, which increases the friction between the drill string and wellbore well. Moreover, the ground driving power loss will increase continually, which leads to WOB (weight on bit) loss and very low ROP. However, current various types of impactor generally have some similar problems, including the inappropriate impact load and low frequency on the rock transmitted from drill bit cutters.

SUMMARY OF THE INVENTION

Therefore, this invention provides a high-frequency composite impactor. A high pressure drilling fluid generates a high-frequency axial impact force through a self-excited cavity of this tool. After the drilling fluid separates, a torsional impact part generates a circumferential torsional impact force, and an impact force acts on the drill bit through the lower joint. Under the impact force of the high-frequency composite impactor, the rock-breaking ability of the drill bit is enhanced. Based on an appropriate combination of high-frequency axial and torsional impact, the invention can solve current drilling problems in complex or deep formations. It can reduce the stick-slip of the drill string, jump drilling and other downhole accidents. By reducing the friction between the drill string and borehole wall, this invention can increase the rock breaking speed and improve the drilling efficiency.

The invention provides a high-frequency composite impactor. During working process, the high-frequency axial impact part converts the stable flowing drilling fluid into a pulsed jet with pressure oscillation to realize high-frequency axial and torsional impact. This invention finally realizes high-frequency multi-directional coupling impact, which can effectively suppress the stick-slip of the drill string and avoid the phenomenon of skipping in complex and deep hard formations.

The technical scheme of the present invention is: a high-frequency composite impactor, located between the drill bit and the upper drill string, comprises a high-frequency axial impact assembly and a torsional impact assembly.

Preferably, in the above-mentioned high-frequency composite impactor of the present invention, the high-frequency axial impact assembly comprises an upper self-excited oscillation cavity, a lower self-excited oscillation cavity, an adjustment block, and a lock nut; the upper self-excited oscillation cavity has with an arc flow channel port, and the lower end has a conical end face. The conical end face may form an angle of 60° with a central axis, and there may be a plurality of (e.g., four) evenly distributed positioning holes in a circumferential direction. The upper self-excited oscillation cavity may be connected with the lower self-excited oscillation cavity by screws; a lower end of the lower self-excited oscillation cavity may have an upwardly protruding conical flow channel port, a conical surface may form an angle of 60° with the central axis and/or a groove with an inner wall. The upper self-excited oscillation cavity and the lower self-excited oscillation cavity may form a self-excited oscillation cavity. Under an action of the conical flow channel port passage, a steady flow of drilling fluid is converted into a pulsed jet with pressure oscillation, enabling high-frequency axial impact. An adjustment block may be between the lower self-excited oscillation cavity and the lock nut. An inner wall of the lock nut may have a hexagonal channel to ensure that the drilling fluid can enter the torsional impact assembly. An outside of the lock nut may have an external thread, which can be connected to the upper joint. The lock nut fixes the entire high-frequency axial impact assembly in the upper casing, and the high-frequency axial impact generated by the high-frequency axial impact part is transmitted to the upper casing.

Preferably, in the above-mentioned high-frequency composite impactor of the present invention, the torsional impact assembly comprises an upper end cover, a lower shell, a pendulum, a reversing fork, a lower end cover, a nozzle, a connecting block, and a retaining ring; the lower shell is between the upper end cover and the lower end cover, and the lower shell is connected with the upper end cover and the lower end cover by screws. The pendulum and the reversing fork may be in the lower shell in sequence. The nozzle may be inside the lower end cover; the connecting block may be between the lower joint and the lower end cover, the retaining ring may be between the lower joint and the connecting block, and the lower joint and the upper joint may be connected by threads. The outer surface of the lower shell may have two symmetrically distributed positioning grooves, which cooperate with the positioning blocks inside the upper joint to perform circumferential positioning of the entire torsional impact part, and at the same time transmit the torsional impact generated by the pendulum to the upper shell.

Preferably, in the above-mentioned high-frequency composite impactor of the present invention, the upper end cover has a high-pressure flow channel port a, a high-pressure flow channel port b, a high-pressure flow channel port c, a high-pressure flow channel port d, four threaded holes a, and a stepped shaft a; the high-pressure flow channel port drains the high-pressure drilling fluid to the torsional impact part, a plurality of (e.g., 4) threaded holes that may correspond to the threaded holes a of the lower shell and that may be connected by screws. The step shaft a is between the reversing switch and the pendulum, forming a closed space to enable state transition.

Preferably, in the above-mentioned high-frequency composite impactor of the present invention, the reversing switch has a central flow channel, two side flow channels, a side flow channel a and a side flow channel b, four stop blocks: stop block a, stop block b, stop block c, stop block d, wherein the central flow channel may be directly connected with the high-frequency axial impact part through the upper end cover, and the side flow channel may be connected with the central flow channel, so that it is always in a high pressure state.

The pendulum may have a plurality (e.g., 8) flow channels: for example, flow channel a, flow channel b, flow channel c, flow channel d, flow channel e, flow channel f, flow channel g, and flow channel h; two pendulums: pendulum a and pendulum b; and two limit blocks: limit block a and limit block b.

The lower shell may have a plurality (e.g., 4) high pressure flow channels: for example, high pressure flow channel a, high pressure flow channel b, high pressure flow channel c, high pressure flow channel d; two pressure relief flow channels: pressure relief flow channel a and pressure relief flow channel b, and two arc grooves: arc groove a and arc-shaped groove b, wherein the high-pressure flow channel corresponds to the high-pressure flow channel port in the upper end cover, so that it is always in a high pressure state; the pressure relief flow channel corresponds to the pressure relief flow of the lower end cover, so that it stays in a pressure relief state.

Preferably, in the above-mentioned high-frequency composite impactor of the present invention, the reversing switch, the pendulum and the lower shell can rotate relative to each other. The rotation of the reversing switch realizes the change of high pressure drilling fluid and low pressure drilling fluid in each flow channel, and the high pressure drilling fluid moves the pendulum to enable a torsional impact.

Preferably, in the above-mentioned high-frequency composite impactor of the present invention, the nozzle is in a hole in the lower end cover. When the upper high pressure drilling fluid passes through the nozzle, a pressure difference may be generated, so that the pressure of the upper end of the torsional impact part is greater than that of the lower end; the connecting block and the lower end cover may form a conical cavity therebetween. The cavity may be connected to the central flow channel and the pressure relief flow channel port, and the connecting block may include an external thread to connect with the lower joint.

Compared with the existing technology, the present invention has the following beneficial effects: The self-excited cavity can make the high-frequency axial impact part generate continuous high-frequency axial impact. The high-frequency axial impact part has no moving parts, which reduces the wear of the parts and increases the service life. The torsional impact part can enable continuous torsional impact in both clockwise and counterclockwise directions. The combination of high-frequency axial impact and torsional impact enables high-frequency composite impact, effectively suppressing stick-slip of drill string and avoiding drill jumps in complex or deep hard formations.

Part names in the figures: 1—upper self-excited oscillation cavity, 101—arc flow channel port, 102—positioning hole, 103—conical end face, 2—adjustment block, 3—upper end cover, 301—high pressure flow channel port a, 302—step shaft a, 303—high pressure flow channel port d, 304—high pressure flow channel port c, 305—threaded hole a, 306—high pressure flow channel port b, 4—pendulum, 401-pendulum a, 402—flow channel a, 403—flow channel b, 404—limit block a, 405—flow channel c, 406—flow channel d, 407—pendulum b, 408—flow channel e, 409—flow channel f, 410—limit block b, 411—flow channel g, 412—flow channel h, 5—lower end cover, 501—pressure relief flow channel port a, 502—step shaft b, 503—pressure relief flow channel port c, 504—pressure relief flow channel port b, 506—pressure relief flow channel port d, 6—retaining ring, 7—upper joint, 8—lower joint, 9—lower self-excited oscillation cavity, 902—conical flow channel port, 903—conical surface, 10—lock nut, 11—reversing switch, 111—stop block a, 112—center flow channel, 113—stop block b, 114—side flow channel b, 115—stop block c, 116—stop block d, 117—side flow channel a, 12—lower shell, 121—arc groove a, 122—high pressure flow channel a, 123—pressure relief flow channel a, 124—high pressure flow channel b, 125—arc groove b, 126—high pressure flow channel c, 127—pressure relief flow channel b, 128—high pressure flow channel d, 13—nozzle, 14—connecting block, 1—pressure relief chamber a, 2—pressure relief chamber b, 3—high pressure chamber a, 4—high pressure chamber b, 5—pendulum chamber a, 6—pendulum chamber b, 7—pendulum chamber c, 8—pendulum chamber d, 9—high pressure chamber c, 10—high pressure chamber d.

DETAILED DESCRIPTION OF THE INVENTION

Figure 1:
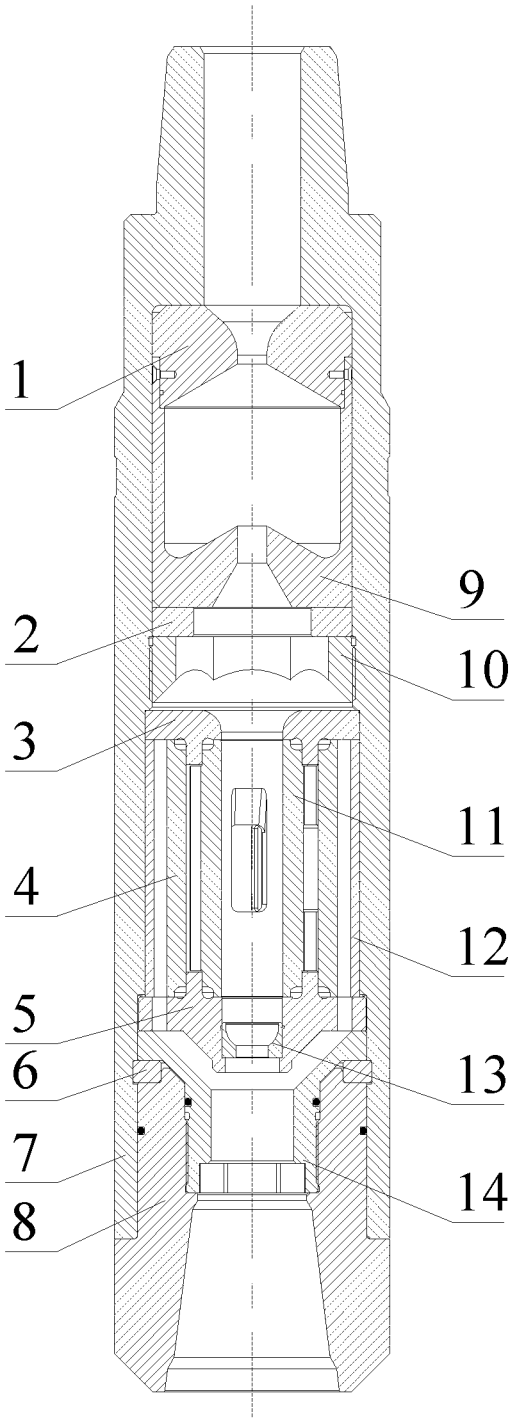
FIG. 1 is a structural diagram showing an example of the present invention.
Figure 2:
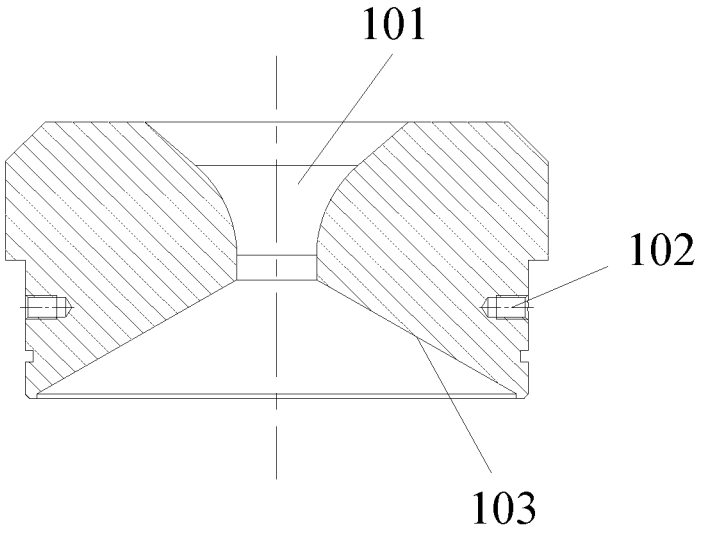
FIG. 2 is the cross-sectional view of the upper self-excited oscillation cavity.
Figure 3:
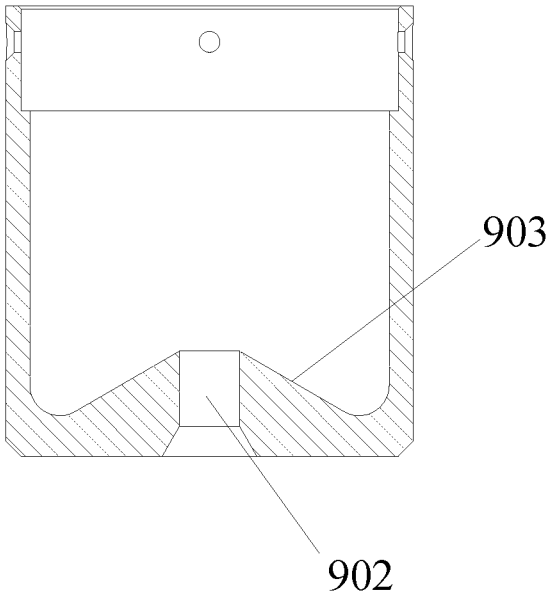
FIG. 3 is the cross-sectional view of the lower self-excited oscillator cavity.
Figure 4:
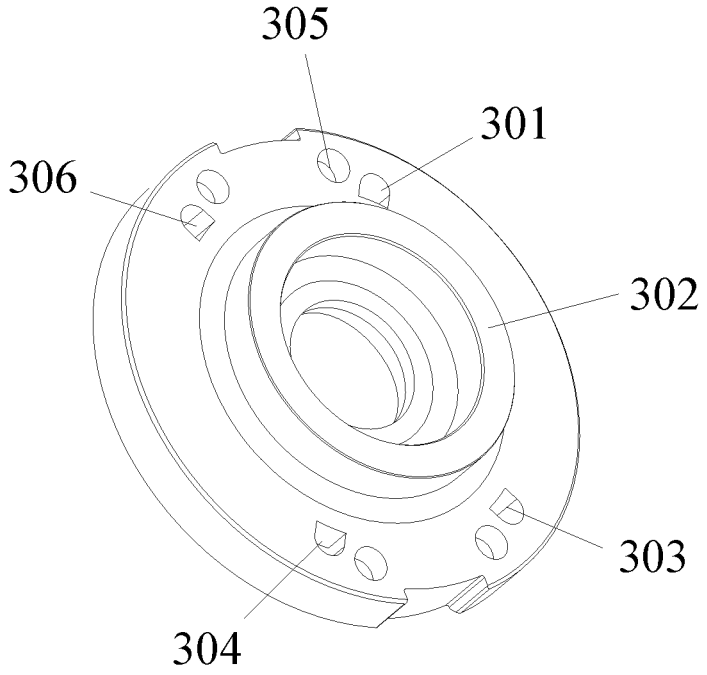
FIG. 4 is the structural schematic of the upper end cover.
Figure 5:
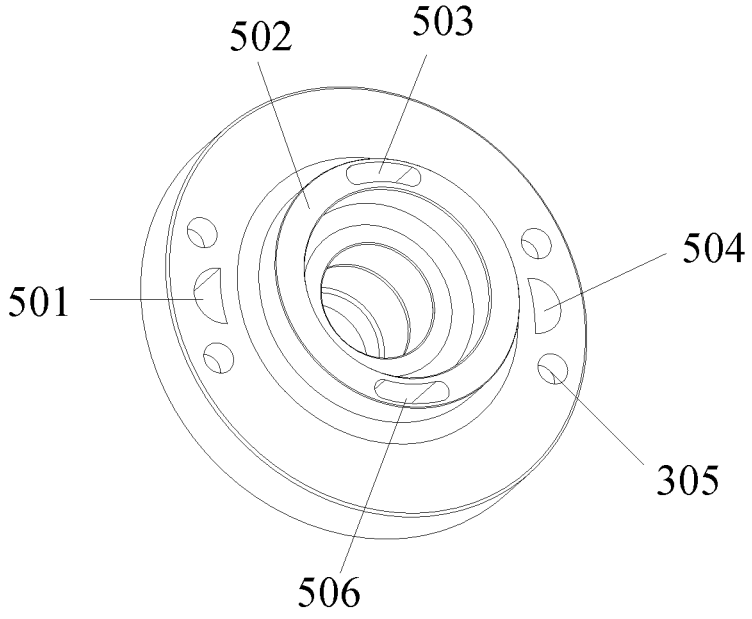
FIG. 5 is the structural schematic of the lower end cover.
Figure 6:
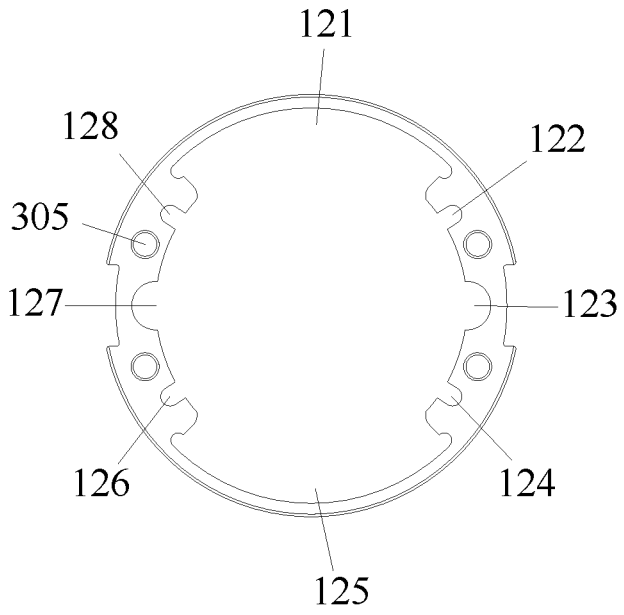
FIG. 6 is the structural schematic of the lower shell.
Figure 7:
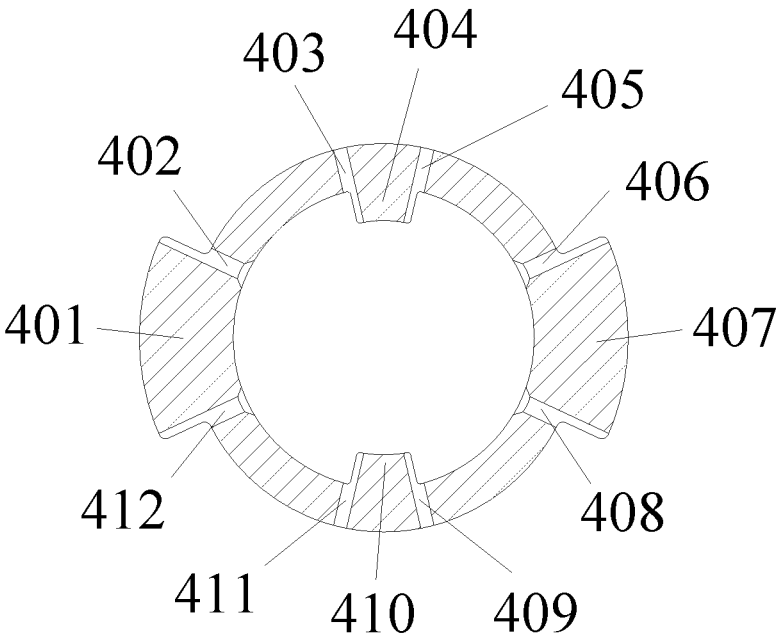
FIG. 7 is the cross-sectional view of a pendulum.
Figure 8:
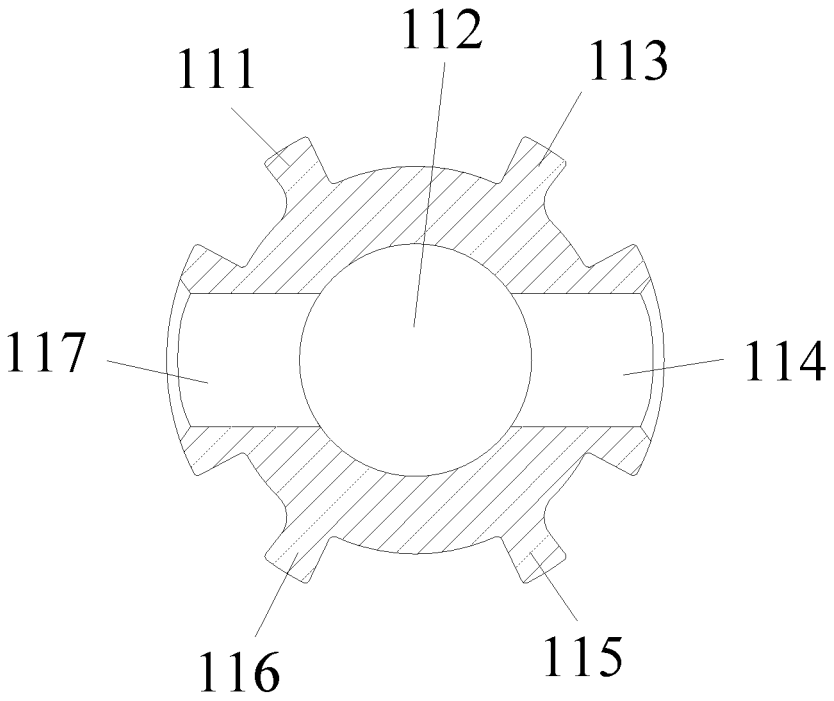
FIG. 8 is the cross-sectional view of the reversing switch.

The present invention will be further described below in conjunction with the accompanying drawings:

As illustrated in FIGS. 1-3, the technical solution of the present invention is: a high-frequency composite impactor is located between the drill bit and the upper drill string, and comprises a high-frequency axial impact assembly and a torsional impact assembly. The high-frequency axial impact assembly comprises an upper self-excited oscillation cavity 1, a lower self-excited oscillation cavity 9, an adjustment block 2, and a lock nut 10; the upper end of the upper self-excited oscillation cavity 1 is configured with an arc flow channel port 101, and the lower end is configured with a conical end surface 103 to form a fluid inlet, and four threaded holes are configured in a circumferential direction. The lower end of the lower self-excited oscillation cavity 9 includes with a conical flow channel port 902, and a conical surface 903 of the conical flow channel port 902 forms an included angle of 60° with an inner wall of the lower self-excited oscillation cavity 9. The adjustment block 2 is between the lower self-excited oscillation cavity 9 and the lock nut 10, and an inner wall of the lock nut 10 includes a hexagonal channel, and an external thread is on the outside.

The torsional impact assembly comprises an upper end cover 3, a lower shell 12, a pendulum 4, a reversing fork 11, a lower end cover 5, a nozzle 13, a connecting block 14, and a retaining ring 6; the lower shell 12 is configured between the upper end cover 3 and the lower end cover 5. The lower shell 12 and the upper end cover 3 are connected by screws, and the lower shell 12 and the lower end cover 5 are connected by screws. Inside the lower shell 12 are sequentially configured with the pendulum 4 and the reversing switch 11. The nozzle 13 is inside the lower end cover 5, the connecting block 14 is between the lower joint and the lower end cover 5, and the retaining ring 6 is between the lower joint 8 and the connecting block 14.

As illustrated in FIGS. 4-8, the technical solution of the present invention is: the high-frequency composite impactor, is between the upper end cover 3 and the lower end cover 5, a threaded hole a305 on the lower shell 12 correspond to the threaded holes a305 on the upper end cover 3 and the lower end cover 5, and are fixed by screws. The pendulum 4 and the reversing switch 11 are sequentially configured inside the lower shell 12; the pressure relief flow channel a 123 of the lower shell 12 is communicated with the pressure relief flow channel port a 501 of the lower end cover, and the pressure relief flow channel b 127 is communicated with the pressure relief flow channel port b 504 of the lower end cover, and is always in a pressure relief state. The high pressure flow channel d 128 corresponds to the high pressure flow channel port b 306, the high pressure flow channel a 122 corresponds to the high pressure flow channel port c 304, the high pressure flow channel b 124 corresponds to the high pressure flow channel port d 303, and the high pressure flow channel c 126 corresponds to the high-pressure flow channel port a 301, and are always in a high pressure state.

The cavities on both sides of a side flow channel a 117 on the side of the reversing switch 11 are in a connected state and are in communication with the pressure relief flow channel port c 503 of the lower end cover 5, and the cavities on both sides of the side flow channel b 114 on the side of the reversing switch 11 are in a connected state and it is communicated with the pressure relief flow channel port d 506 of the lower end cover 5; a pendulum chamber a 5 and a pendulum chamber c 7 communicate with the side flow channel a 117 or the pressure relief flow channel port c 503 through a flow channel a 402 and a flow channel h 412 to enable pressurization and pressure relief. The pendulum chamber b 6 and the pendulum chamber d 8 communicate with a side flow channel b 114 or a pressure relief flow channel port d 506 through a flow channel d 406 and a flow channel e 408 to enable pressurization and pressure relief, and complete the torsional impact action.

Figure 9:
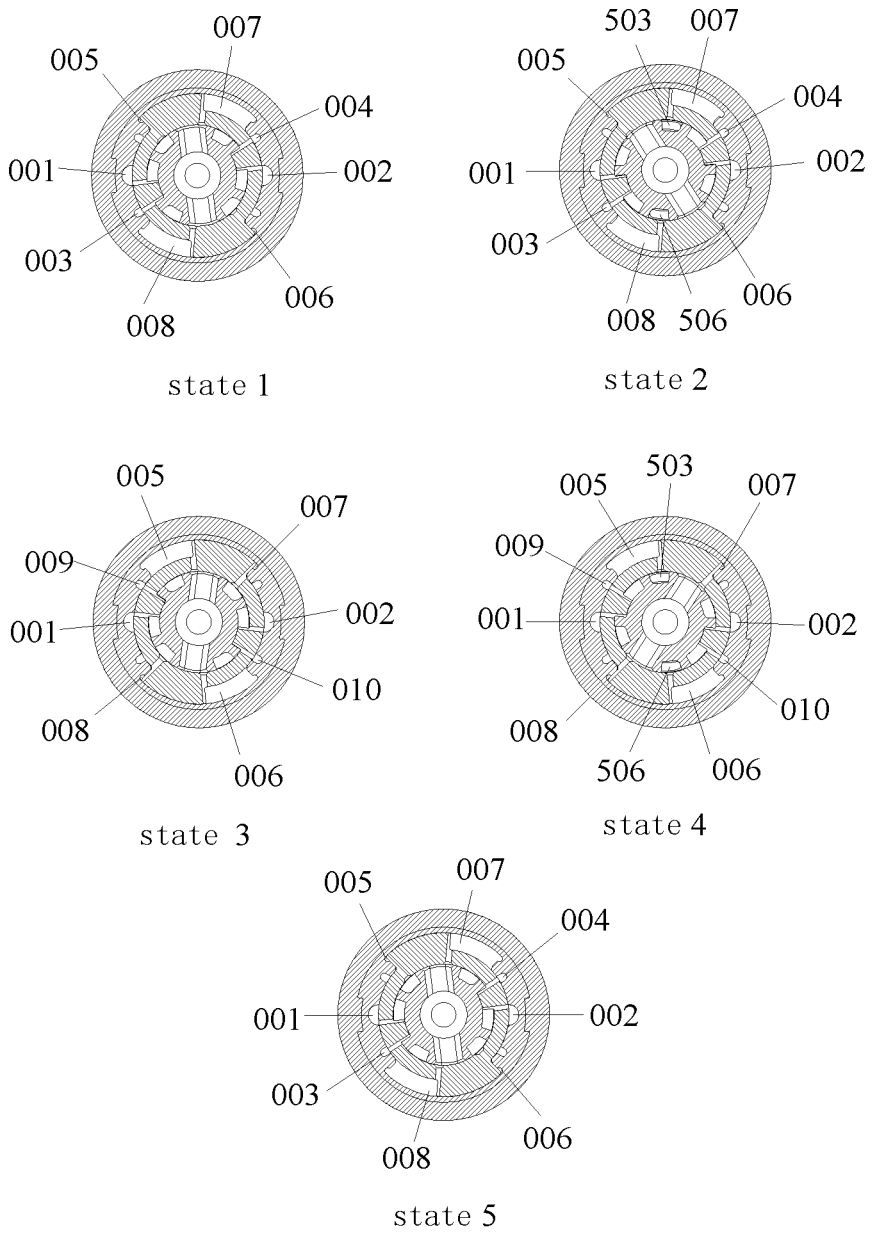
FIG. 9 is the state diagram of a torsional impact part.

Referring to FIG. 9, in a specific example, the torsional impact assembly has five states for completing one impact, including state 1, state 2, state 3, state 4, and state 5. From state 1 to state 3, it is a clockwise impact process, and from state 3 to state 5, it is a counterclockwise impact process. The two processes are converted into each other to complete the continuous axial impact. The specific impact process is:

The state 1 is set as the initial state of the clockwise impact process of the torsional impact part. The pressure relief flow channel a 123, the flow channel g 411 and the stop block d 116 form a pressure relief chamber a 1; the pressure relief flow channel b 127, the flow channel c 405 and the stop block b 113 form a pressure relief chamber b 2; the high pressure flow channel a 122, the flow channel b 403 and the stop block a 111 form a high pressure chamber a 3; the high pressure flow channel c 126, the flow channel f 409 and the top block c 115 form a high pressure chamber b 4; the arc groove a 121, the flow channel h 412 and the stop block d 116 form a pendulum chamber a 5, the arc groove b 125, the flow channel d 406 and the stop block b 113 form a pendulum chamber b 6; the arc groove a 121, the flow channel a 402 and the side flow channel a 117 form a pendulum chamber c 7; and the arc groove b 125, the flow channel e 408 and the side flow channel b 114 form a pendulum cavity d 8.

The high pressure drilling fluid enters the high pressure chamber a 3 from the high pressure flow channel port a 301 of the upper end cover 3, then into the high pressure chamber b 4 through the high pressure flow channel port c 304. At the same time, the pressure relief chamber a 1 and the pressure relief chamber b 2 are in a pressure relief state. The reversing switch 11 is rotated counterclockwise due to the drilling fluid pressure, and the torsional impact portion is switched from state 1 to state 2. At this time, in state 2, the pendulum chamber a 5 communicates with the side flow channel a 117, the pendulum chamber b 6 communicates with the side flow channel b 114, the pendulum chamber c 7 communicates with the pressure relief flow channel port c 503, and the pendulum chamber d 8 communicates with the pressure relief flow channel port d 506. Next, the high pressure drilling fluid in the central flow channel 112 enters the pendulum chamber a 5 and the pendulum chamber b 6 through the two side flow channels, pushes the pendulum 4 to rotate clockwise, and the limit block a 404 inside the pendulum pushes the stop block d 116, so that the reversing switch 11 rotates clockwise synchronously with the pendulum 4 to complete one clockwise impact, and the torsional impact part transitions from state 2 to state 3. At this time, the high pressure flow channel d 128, the flow channel g 411 and the stop block d 116 form a high pressure chamber c 9, and the high pressure flow channel b 124, the flow channel c 405 and the stop block a 113 form a high pressure chamber d 10; the high pressure drilling fluid enters the high pressure chamber c 9 from through the high pressure flow channel port b 306 in the upper end cover 3, then into the high pressure chamber d 010 through the high pressure flow channel port d 303. The pressure relief chamber a 1 and the pressure relief chamber b 2 are in a pressure relief state. Under the pressure of the drilling fluid, the reversing switch 11 rotates clockwise to the limit ultimate position, and the torsional impact part transitions from state 3 to state 4.

After the torsional impact part completes the clockwise impact, it enters the counterclockwise impact, and state 4 is set as the initial state of the counterclockwise impact. At this time, the pendulum chamber c 7 in state 3 communicates with the side flow channel a 117, the pendulum chamber d 8 communicates with the side flow channel b 114, the pendulum chamber a 5 communicates with the pressure relief flow channel port c 503, and the pendulum chamber b 6 communicates with the pressure relief chamber d 506. When the high pressure drilling fluid in the central flow channel 112 enters the pendulum chamber c 7 and the pendulum chamber d 8 through the two side flow channels and pushes the pendulum 4 to rotate counterclockwise, and the limit block b 410 inside the pendulum 4 pushes the stop block a 111. The reversing switch 11 and the pendulum 4 are made to rotate counterclockwise synchronously to complete one counterclockwise impact, and the torsional impact part is converted from state 4 to state 5. At this time, the high pressure drilling fluid enters the high pressure chamber a 3 through the high pressure flow channel port a 301 on the upper end cover 3, then into the high pressure chamber a 4 through the high pressure flow channel port c 304. At the same time, the pressure relief chamber a 1 and the pressure relief chamber b 2 are in a pressure relief state. Under the action of the drilling fluid pressure, the reversing switch 11 rotates counterclockwise, and the torsional impact part switches from state 5 to state 2. At this point, a complete torsional impact process completes, and this reciprocating process is repeated under the action of the drilling fluid to complete continuous torsion impacts.

The above content is merely an example to describe the structure of the present invention. Technical personnel in the technical field can make various modifications or additions to the specific embodiments described or use similar methods to replace them, as long as such modifications or additions do not deviate from the structure of the invention or go beyond the present invention, they shall all fall into the protection scope of the present invention defined by the claims of the invention.

What is claimed is:

1. A high-frequency composite impactor comprising a high-frequency axial impact assembly, a torsional impact assembly, and a lower joint, wherein:

the high-frequency axial impact assembly includes: an upper self-excited oscillation cavity, a lower self-excited oscillation cavity, an adjustment block, and a lock nut;

the upper self-excited oscillation cavity has an upper end configured with an arc flow channel port, and a lower end configured with a conical end face to form a fluid inlet, and four circumferential positioning holes;

the lower self-excited oscillation cavity has an inner wall and a lower end configured with a conical flow channel port forming a groove structure with the inner wall;

the adjustment block is between the lower self-excited oscillation cavity and the lock nut;

the lock nut has an inner wall with a hexagonal channel and an external thread;

the torsional impact assembly includes: an upper end cover, a lower shell, a pendulum, a reversing switch, a lower end cover, a nozzle, a connecting block, and a retaining ring;

the lower shell is between the upper end cover and the lower end cover, connected by screws;

the nozzle is inside the lower end cover to form a torsional impact part;

the connecting block is between the lower joint and the lower end cover; and the retaining ring is between the lower joint and the connecting block.

2. The high-frequency composite impactor according to claim 1, wherein the upper self-excited oscillation cavity and the lower self-excited oscillation cavity are configured with four corresponding positioning holes.

3. The high-frequency composite impactor according to claim 2, wherein the conical flow channel port has a conical surface, and the conical surface and the inner wall of the conical flow channel port are at an angle of 60°.

4. The high-frequency composite impactor according to claim 2, wherein the upper self-excited oscillation cavity and the lower self-excited oscillation cavity form a high frequency axial impact section.

5. The high-frequency composite impactor according to claim 1, wherein: the upper end cover includes a first high pressure flow channel port, a second high pressure flow channel port, a third high pressure flow channel port, a fourth high pressure flow channel port, a first plurality of threaded holes, and a step shaft.

6. The high-frequency composite impactor according to claim 5, wherein at least one of the high pressure flow channel ports drains a drilling fluid to the torsional impact part; the lower shell includes a second plurality of threaded holes; the first threaded holes are distributed circumferentially in the upper end cover; the first and second pluralities of threaded holes are connected by screws; and the step shaft is between the reversing switch and the pendulum.

7. The high frequency composite impactor according to claim 1, wherein: the reversing switch includes a central flow channel, first and second side flow channels, a first stop block, a second stop block, a third stop block, and a fourth stop block.

8. The high frequency composite impactor according to claim 7, wherein the pendulum comprises a first flow channel, a second flow channel, a third flow channel, a fourth flow channel, a fifth flow channel, a sixth flow channel, a seventh flow channel, an eighth flow channel, a first pendulum, a second pendulum, a first limit block, and a second limit block.

9. The high frequency composite impactor according to claim 7, wherein the lower shell comprises a first high pressure flow channel, a second high pressure flow channel, a third high pressure flow channel, a fourth high pressure flow channel, a first pressure relief flow channel, a second pressure relief flow channel, a first arc groove, and a second arc groove.

10. The high frequency composite impactor according to claim 7, wherein the reversing switch, the pendulum and the lower shell rotate relative to each other, rotation of the reversing switch enables a change of drilling fluid in each flow channel, and the drilling fluid moves the pendulum.

11. The high-frequency composite impactor according to claim 1, wherein the lower end cover comprises a first pressure relief flow channel port, a second pressure relief flow channel port, a third pressure relief flow channel port, a fourth pressure relief flow channel port, a third plurality of threaded holes, and a stepped shaft.

12. The high-frequency composite impactor according to claim 11, wherein the first pressure relief flow channel port and the third pressure relief flow channel port are on the stepped shaft.

13. The high-frequency composite impactor according to claim 12, wherein the stepped shaft is between the reversing switch and the pendulum.

14. The high-frequency composite impactor according to claim 1, wherein the nozzle is in a hole in the lower end cover, so that when the drilling fluid passes through the nozzle, a pressure difference is generated.

15. The high-frequency composite impactor according to claim 14, wherein the connecting block and the lower end cover form a conical cavity therebetween, connecting the central flow channel and the pressure relief flow channel port.

16. The high-frequency composite impactor according to claim 14, wherein the connecting block includes an external thread to be connected with the lower joint.

* * * * *